US005738529A

United States Patent [19]

Wedell et al.

[11] Patent Number: 5,738,529

[45] Date of Patent: Apr. 14, 1998

[54] CABLE CONNECTOR SYSTEM

[75] Inventors: Howard O. Wedell, Oak Forest; Gerald J. Ingles, Big Rock, both of Ill.

[73] Assignee: Methode Electronics, Inc., Chicago, Ill.

[21] Appl. No.: 617,955

[22] Filed: Feb. 29, 1996

[51] Int. Cl.[6] ..... H01R 9/09; H01Q 1/50

[52] U.S. Cl. ..... 439/63; 343/906; 439/581; 439/98

[58] Field of Search ..... 439/63, 581, 916, 439/98; 343/713, 906

[56] References Cited

U.S. PATENT DOCUMENTS 4,169,650 10/1979 Schweizer ..... 439/581
5,479,179 12/1995 Hirotsu et al. ..... 343/713

*Primary Examiner*—Neil Abrams
*Assistant Examiner*—Yong Ki Kim
*Attorney, Agent, or Firm*—David L. Newman

[57] ABSTRACT

A cable connector system is provided having a carrier strip and a center contact mounted to a conductive trace of a substrate, such as an automotive window glass, at a predetermined distance from the carrier strip to receive a stripped cable, such as a coaxial cable in order to provide for the quick and easy attachment of the cable to the substrate, such as for attachment of a cellular phone to an antenna on automotive window glass.

12 Claims, 3 Drawing Sheets

CABLE CONNECTOR SYSTEM

BACKGROUND OF THE INVENTION

This invention pertains to a cable connector system and, in particular, a connector for coaxial cables. The mounting of coaxial cable to substrates have been acomplished by many means such as coaxial connector connected to the cable and mounting the coaxial connector to a substrate or soldering the coaxial cable directly to a substrate. In certain circumstance such as the attachment of coaxial cable to the rear window of an automobile, in order to attach a telephone or radio to an antenna in the window, a cable lead was soldered directly to the glass. However, such assembly leaves a flying lead where the cable is attached to the glass at one end and is free at the other end. During installation of the glass into the automobile, the flying lead gets in the way and, in some cases, may be used as a handle by assembly line workers to pick up the glass. Such handling can cause damage to the connection of the cable to the glass. There is, therefore, desired a system which provides for a low cost, low profile connector for a substrate such as glass and allows for the later insertion and mounting of a cable within the connector system after assembly of the substrate into its final position.

It is, therefore, an object of the present invention to provide for a low cost, low profile connector system which enables for the quick and easy insertion of an electrical cable to provide for an electrical connection.

It is a further object of the present invention to provide a connector system which allows for the connection of a coaxial cable to a glass substrate quickly and inexpensively.

It is another object of the present invention to provide a connector system which allows for the insertion of a cable therein and restricts the removal of the cable tereafter.

It is a further object of the present invention to provide a connector system which is quickly and easily mountable to a substrate and quickly and easily soldered thereto.

SUMMARY OF THE INVENTION

A principal object of this invention is to provide a connector system comprising a carrier strip having a generally U-shaped area and a retention strip mounted at the U-shaped area and a center contact mounted to a substrate a predetermined distance from the carrier strip, wherein a cable inserted through the carrier strip is received by the center contact. The carrier strip may include mounting tabs having solder adhered thereto for mounting the carrier strip to the substrate. The carrier strip and the center contact may be mounted to a housing. The substrate may be a window glass having an antenna embedded therein, attached to a trace which is connected to the carrier strip and the center contact. The retention strip may include a plurality of fingers bent around the edge of the U-shaped area of the carrier strip and protruding within the U-shaped area of the carrier strip. The mounting tabs of the carrier strip may include offset dimples protruding therefrom.

In an embodiment, a cable connector is provided comprising a carrier strip having a generally U-shaped area and mounting tabs adjacent the U-shaped area, solder attached to the mounting tabs and a retention strip mounted to the U-shaped area having retention fingers protruding within the U-shaped area. The mounting tabs may include offset dimples protruding therefrom. The connector may be mounted to a conductive trace on a window glass. The carrier strip may be mounted to a housing which is attached to a center contact.

A method of attaching a cable to a substrate is provided comprising the steps of mounting a carrier strip having a U-shaped area and a retention strip attached at the U-shaped area to a conductive trace of the substrate, mounting a center contact to the conductive trace of the substrate, assembling the substrate to a finished piecework, and inserting the stripped end of a cable having an exposed conductor and a cable shield bent back over the outer jacket of the cable through the U-shaped portion of the carrier strip and inserting the conductor within the center contact, wherein the cable is electrically connected to the conductive trace and grounded thereto. The carrier strip and the center contact may be mounted in a housing prior to mounting to the substrate and wherein the carrier strip and the center contact are mounted to the substrate simultaneously. The connector assembly may provide for the electrical connection of a coaxial cable to an antenna embedded in the window glass substrate which the carrier strip and the center contact are mounted to.

These and other features of the invention are set forth below in the following detailed description of the presently preferred embodiments.

DETAILED DESCRIPTION OF THE PRESENTLY PREFERRED EMBODIMENTS

Figure 1:
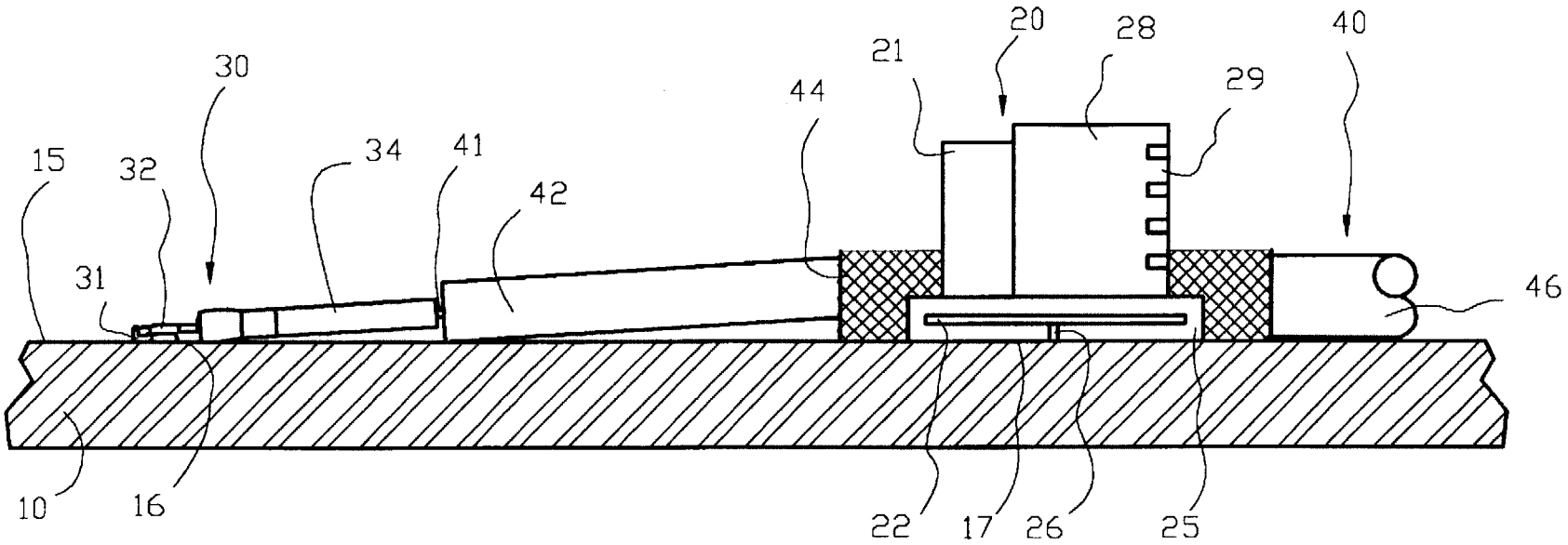
FIG. 1 is a side elevational view of the present invention in its fully assembled state.
Figure 2:
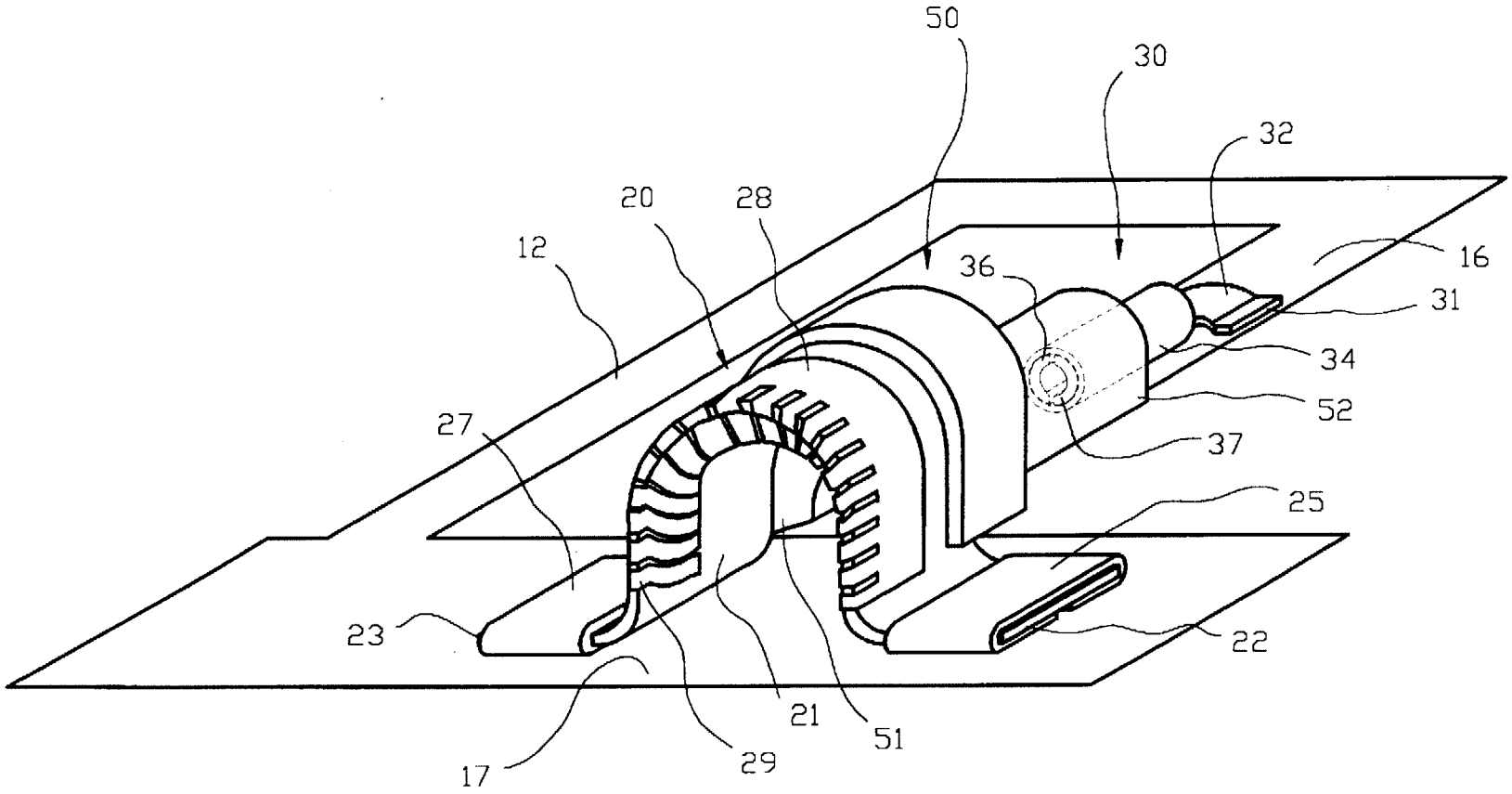
FIG. 2 is a perspective view of the connector system of the present invention prior to insertion of the cable.
Figure 3:
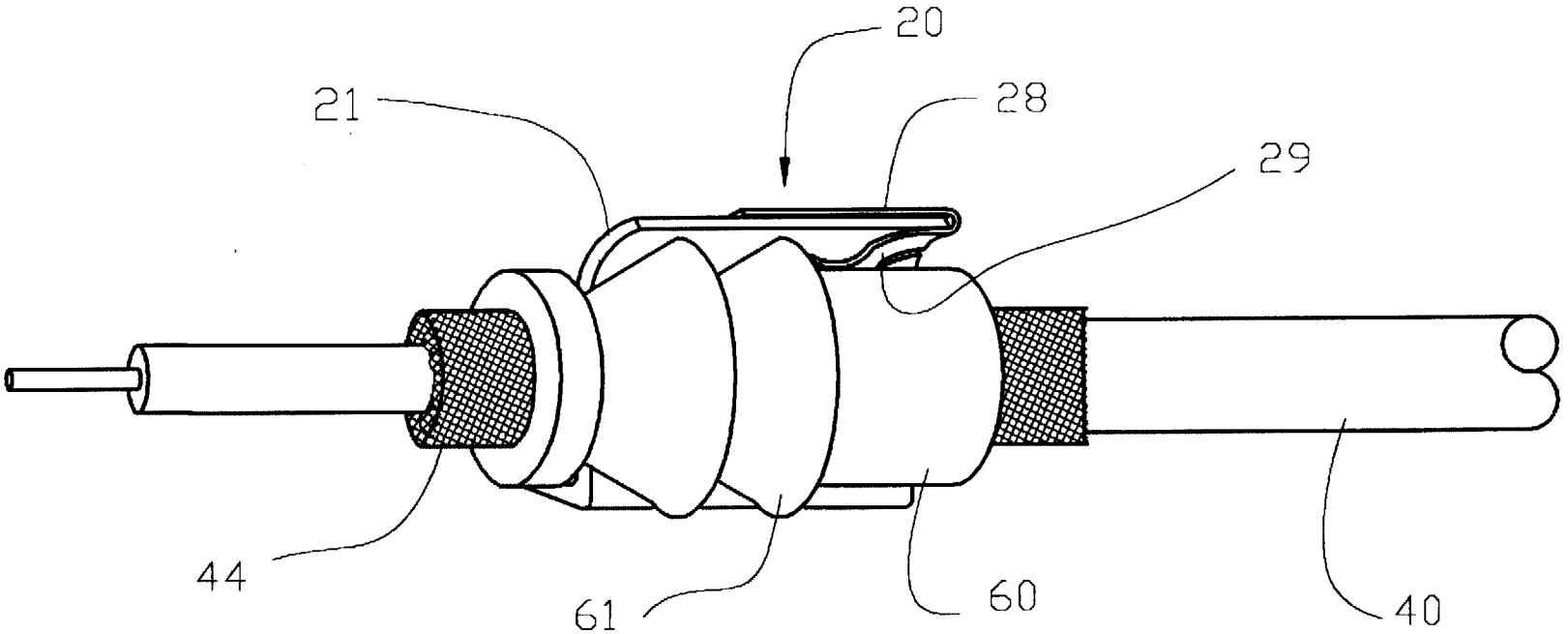
FIG. 3 is a side partially cut-away view of an alternate embodiment of the present invention.

The invention is best understood with reference to FIGS. 1–3. FIG. 1 discloses a substrate 10, for example, window glass for an automobile. The substrate includes conductive tracing on its outer surface 15 and includes mounting points 16, 17. Prior to mounting of the substrate 10 to the finished assembly such as at the rear of an automobile, a carrier strip 20 is mounted at mounting point 17 to the substrate 10. The carrier strip includes a U-shaped area 21 and mounting tab 22. In a preferred embodiment, the carrier strip 20 is formed of a metallic material such as tin/copper. Attached to the mounting, tab 22 is solder, such as solder preform 25. However, solder cladding may also be adhered to the mounting tab 22. The mounting tab 22 also has protruding from it an offset dimple 26. Also mounted at the U-shaped area 21 of the carrier strip 20 is retention strip 28 having fingers 29 which are bent around and protrude into the interior of the U-shaped area 21. The retention strip 28 in a preferred embodiment is resistance-welded or riveted to the carrier strip 20.

The carrier strip 20 is mounted to mounting point 17 by placing the mounting tabs 22 parallel with the surface 15 of the substrate 10. The mounting point 17 includes a conductive trace which may be abraded and the mounting tabs 22 mounted thereon and applying heat to the tabs 22. The solder 25 reflows and forms an electrical connection between the carrier strip 20 and the mounting point 17 on the substrate 10. The offset dimple 26 of the mounting tab 22 provides for a space to be retained between the bottom of the mounting tab 22 and the surface 15 of the substrate 10. Therefore, applying pressure to the mounting tab 22 will not force the solder 25 to be pushed out from out underneath the mounting tab 22. In a preferred embodiment, a heating element is placed down over the mounting tab 22 and puts pressure on the tab 22 in the downward direction against the substrate 10. To avoid squeezing the solder 25 out from underneath the mounting tab 22, the offset dimple 26 retains an offset of the mounting tab 22 from the substrate 10 so that solder remains underneath the tab and a good electrical connection is achieved. In an alternate embodiment, a pair of offset dimples may protrude from each mounting tab 22. In a preferred embodiment the carrier strip may be formed in a punch press to simultaneously form the U-shaped area 21, the, mounting tabs 22 and the offset dimple 26.

Spaced apart from the carrier strip 20 is center contact 30 which is mounted at mounting point 16 to the substrate 20. The center contact 30 includes mounting wings 31, contact body 32 and outer sleeve 34. The contact body 32 is inserted through the length of the outer sleeve 34 and forms two contact arms for receiving a conductor 41 of a cable 40. The mounting wings 31 of the center contact 30 have solder attached thereto such as a solder cladding or solder preforms. The center contact 30 is attached to the substrate 10 by heating of the solder and forming an electrical connection between the center contact 30 and the mounting point 16. The center contact 30 may be mounted to the substrate 10 separately from or simultaneously with the carrier strip 20. The entire assembly (as shown in FIG. 2) may then be stored and transported for later assembly to the finished piecework or automobile. It may be understood from the aforementioned description of the present invention that the finished substrate assembly does not have lengthy appendages or cables hanging therefrom or connectors which are obtrusive or difficult to attach. The center contact 30 and the carrier strip 20 provide for a quick and easy connector system which allow for a cable to be attached to the substrate 10 in a quick and easy method at a later assembly stage.

In a preferred embodiment of the present invention, the substrate or window glass having the carrier strip 20 and the center contact 30 mounted thereto is placed into the rear of an automobile body. The low profile carrier strip 20 and center contact 30 allow for the manipulation of the substrate 10 into the automobile body and do not hinder such assembly. Once the substrate or window glass 10 is mounted into the automobile, a cable 40 may then be inserted into the connector assembly of the present invention in order to connect an electronic apparatus such as a telephone to an antenna embedded into the window glass 10. Prior to insertion of the cable 40 into the connector system, the cable is stripped, exposing the conductor 41 which is covered by insulator 42. A cable shield 44 is also exposed and is folded back over the outer jacket 46 of the cable 40. The cable is stripped to a particular size so that the cable shield 44 is folded back at a predetermined distance from the exposed conductor 41 (see FIG. 3). The cable is inserted through the U-shaped area 21 of the carrier strip 20. The cable 40 is inserted through the carrier strip 20 until it reaches its final mated position having the cable 44 shield centered within the carrier strip 20 and the conductor 41 mated to the center contact 30. The fingers 29 of the retention strip 28 abut against the cable shield 44 and help to retain the cable 40 within the carrier strip 20 and simultaneously provide for grounding of the cable to the substrate 10. In a preferred embodiment, the retention strip 28 is made of a beryllium copper which enhances grounding and electrostatic discharge.

The cable 40 in its final mated position provides for the conductor 41 to be inserted within the center contact 30 within the outer sleeve 34 to provide for an electrical connection to the substrate 10 at the mounting point 16. Therefore, it may be appreciated that the present connector system provides for a quick and easy installation of a cable to the substrate and simultaneously provides for grounding of the cable. In a preferred embodiment, the cable 40 needs no further assembly and is retained within the connector assembly and attach to the substrate and allows for the cable to withstand a pull force of approximately one to ten pounds without removal from the carrier strip 20 or center contact 30. In an alternate embodiment, the cable may be secured more to the substrate 10 by use of solder or other mechanical means.

FIG. 2 is a perspective view of the connector system of the present invention prior to insertion of a cable. Substrate 10 includes trace 12 adhered to the upper surface and providing for mounting points 16,17. The carrier strip 20 includes U-shaped area 21 and mounting tabs 22,23. Mounted on the U-shaped area 21 is retention strip 28 having a plurality of fingers 29 bent over and protruding within the U-shaped area 21 of the carrier strip 20. Attached to the mounting tabs 22,23 are solder preforms 25,27. Heat is applied to the mounting tabs 22,23 and the solder 25,27 is reflowed providing for an electrical connection between the carrier strip 20 and the conductive trace 17 of the substrate 10 so that the cable may be grounded when inserted therein.

Center contact 30 is mounted to the substrate a predetermined distance from the carrier strip 20. The center contact 30 includes outer sleeve 34, contact body 32 and mounting wings 31. Protruding within the outer sleeve 34 are contact fingers 36,37 for receiving the conductor of a cable. In a preferred embodiment, the contact body 32 and fingers 36,37 are formed of a metallic material such as a beryllium copper and the outer sleeve 34 is formed of an insulating material such as a rubber or thermoplastic material. The outer sleeve 34 protects the contact fingers 36,37 and also maintains the fingers in a prestressed position providing for a normal force of the contact fingers 36,37 in order to provide a press-fit with a conductor of a cable.

FIG. 2 also discloses an alternate embodiment of the present invention having a housing 50. The housing 50 provides for a means of holding the carrier strip 20 and the center contact 30 together as a single unit. In order to aid in the quick assembly of the present connector system, the carrier strip 20 and the center contact 30 may be mounted to the housing 50 prior to installation to the substrate 10. The housing 50 may be picked up and placed onto the substrate 10 providing for the simultaneous placement of the carrier strip 20 and the center contact 30 at their desired positions at mounting positions 16,17. The housing may be designed so that is easily grasped by human fingers for placement or for automated robotic pick and placement. The housing 50 also includes a tapered interior 51 and a reduced diameter portion 52 which guides the cable to the opening of the center contact 30 and is easily inserted between the contact fingers 36,37. The housing 50 is attached to the U-shaped area 21 of the carrier strip 20 by any conventional means, such as by chemical bonding or a mechanical clip. The housing 50 includes an opening at its end adjacent the reduced diameter portion 52 in order to receive the center contact 30 which is attached thereto by any conventional means such as chemical bonding or a mechanical clip. The housing 50 in a preferred embodiment is made of a non-conductive material such as a thermoplastic. The housing 50 is formed so that it does not protrude over the mounting tabs 22,23 so that they are exposed in the upwardly perpendicular direction so that a heating element may be placed down over the carrier strip 20 without interference in order to solder the carrier strip 20 to the substrate 10. Therefore, it may be understood that the present invention provides for a connector system which allows for a cable, such as a coaxial cable, to be quickly and easily installed to a substrate 10 such as window glass. Insertion of the cable through the U-shaped portion 21 of the carrier strip 20 and mating of the stripped conductor with the contact fingers 36,37 of the center contact 30 provides for electrical connection of the cable to the trace 12. Simultaneously, the cable having the cable shield bent back over the outer jacket of the cable is grounded to the substrate through the retention strip 28 via fingers 29 abutting the cable shield.

FIG. 3 discloses a side partially cut-away view of an alternate embodiment of the present invention. The cable 40 is shown inserted within the carrier strip 20 which is partially cut away to expose the cable 40. In the alternative embodiment, a ferrule 60 has been placed over the cable shield 44 and crimped onto the cable 40. The ferrule may have ribs 61 or the crimping procedure of the ferrule 60 onto the cable 40 may form the ribs 61. The ribs 61 are angled so that the cable 40 may be easily inserted within the U-shaped area 21 of the carrier strip 20. Upon insertion of the cable 40, the ribs 61 of the ferrule 60 abut against the fingers 29 of the retention strip 28 mounted to the carrier strip 20. It can thus be understood that the removal of the cable is inhibited by the plurality of fingers 29 abutting against the ribs 61 of the ferrule 60 which is crimped to the cable 40. In a preferred embodiment, the retention strip 28 may withstand a pull of force of approximately one to ten pounds. The ferrule 60, in a preferred embodiment, is formed of a metallic material such as tin-plated copper in order that the grounding of the cable 40 occur through the retention strip 28 and the carrier strip 20 to the substrate 10.

It should be understood that various changes and modifications to the presently preferred embodiments described herein will be apparent to those skilled in the art. Such changes and modifications may be made without departing from the spirit and scope of the present invention and without diminishing its attendant advantages. For example, it has been described herein that the connector system of the present invention in a preferred embodiment is used for attachment of a coaxial cable to an antenna embedded in automotive window glass. However, the cable connector system of the present invention may be used to connect any type of cable to any type of substrate. It is, therefore, intended that such changes and modifications be covered by the appended claims.

What is claimed is:

1. a connector system comprising:

a carrier strip having a generally U-shaped area, mounting tabs having solder adhered thereto for mounting the carrier strip to the substrate and a retention strip mounted at the U-shaped area; and a center contact mounted to a substrate a predetermined distance from the carrier strip wherein a cable inserted through the carrier strip is received by the center contact.

2. The connector system of claim 1 wherein the carrier strip and the center contact are mounted to a housing.

3. The connector system of claim 1 wherein the substrate is a window glass having an antenna embedded therein, attached to a trace which is connected to the carrier strip and the center contact.

4. The connector system of claim 1 wherein the retention strip includes a plurality of fingers bent around the edge of the U-shaped area of the carrier strip and protruding within the U-shaped area of the carrier strip.

5. The connector of claim 1 wherein the mounting tabs of the carrier strip include offset dimples protruding therefrom.

6. A cable connector comprising:

a carrier strip having a generally U-shaped area and mounting tabs adjacent the U-shaped area;

solder attached to the mounting tabs for attaching the carrier strip to a substrate; and a retention strip mounted to the U-shaped area having retention fingers protruding within the U-shaped area for retaining a cable inserted within the U-shaped area of the carrier strip.

7. The connector of claim 6 wherein the mounting tabs include offset dimples protruding therefrom.

8. The connector of claim 7 wherein the connector is mounted to a conductive trace on a window glass.

9. The connector of claim 8 wherein the carrier strip is mounted to a housing which is attached to a center contact.

10. A method of attaching a cable to a substrate comprising the steps of:

mounting a carrier strip having a U-shaped area and a retention strip attached at the U-shaped area to the conductive trace of the substrate;

mounting a center contact to a conductive trace of the substrate;

assembling the substrate to a finished piecework;

inserting the stripped end of a cable having an exposed conductor and a cable shield bent back over the outer jacket of the cable through the U-shaped portion of the carrier strip and inserting the conductor within the center contact, wherein the cable is electrically connected to the conductive trace and grounded thereto; and mounting the carrier strip and the center contact in a housing prior to mounting to the substrate and wherein the carrier strip and the center contact are mounted to the substrate simultaneously.

11. The method of claim 10 wherein a connector assembly provides for the electrical connection of a coaxial cable to an antenna embedded in a window glass substrate which the carrier strip and the center contact are mounted to.

12. The connector system of claim 1 wherein the predetermined distance is determined in accordance with a functional frequency of the connector system.

* * * * *